US006446829B1

(12) United States Patent
Malvasio et al.

(10) Patent No.: US 6,446,829 B1
(45) Date of Patent: Sep. 10, 2002

(54) PAINT BRUSH HOLDER AND WIPER UNIT

(76) Inventors: William A. Malvasio, 2523 N. Lake Dr., Milwaukee, WI (US) 53211; Catherine A. Malvasio, 2523 N. Lake Dr., Milwaukee, WI (US) 53211

( * ) Notice: Subject to any disclaimer, the term of this patent is extended or adjusted under 35 U.S.C. 154(b) by 47 days.

(21) Appl. No.: 09/841,092

(22) Filed: Apr. 25, 2001

(51) Int. Cl.[7] ..... B65D 25/00
(52) U.S. Cl. ..... 220/697; 698/700; 698/736
(58) Field of Search ..... 220/700, 699, 220/701, 697, 698, 735, 736, 636

(56) References Cited

U.S. PATENT DOCUMENTS

| | | | | | |
|---|---|---|---|---|---|
| 2,715,478 | A | | 8/1955 | Andersen | 220/90 |
| 2,748,977 | A | | 6/1956 | Sarchet | 220/90 |
| 2,919,828 | A | | 1/1960 | Lemke | 220/90 |
| 3,133,668 | A | | 5/1964 | Heise | 220/90 |
| 3,407,429 | A | | 10/1968 | Dinardo | 15/257 |
| 3,688,943 | A | | 9/1972 | Brown | 220/90 |
| 3,948,413 | A | | 4/1976 | Gorrell | 220/90 |
| 4,009,802 | A | | 3/1977 | Hayduchok | 222/108 |
| 4,203,537 | A | | 5/1980 | McAlister | 222/570 |
| 4,247,013 | A | | 1/1981 | O'Hori | 220/90 |
| 4,275,818 | A | | 6/1981 | Church | 220/90 |
| 4,353,476 | A | | 10/1982 | Cowgill | 220/85 D |
| 4,436,217 | A | | 3/1984 | Ritter | 220/85 D |
| D300,970 | S | | 5/1989 | Walker | D32/54 |
| D305,820 | S | | 1/1990 | Beato | D32/54 |
| 4,890,807 | A | * | 1/1990 | Desjardins | |
| 4,969,617 | A | * | 11/1990 | Desjardins | 220/700 |
| 4,993,671 | A | | 2/1991 | Ste. Marie | 248/113 |
| 5,076,519 | A | | 12/1991 | Panovic | 248/110 |
| D327,148 | S | | 6/1992 | Alessi | D32/54 |
| D329,576 | S | | 9/1992 | Desjardin | D8/14 |
| D332,854 | S | | 1/1993 | Waterson | D34/10 |
| 5,195,662 | A | * | 3/1993 | Neff | 220/700 |
| D341,686 | S | | 11/1993 | Panovic | D32/54 |
| 5,261,577 | A | | 11/1993 | Goldstein | 220/697 |
| 5,297,695 | A | | 3/1994 | Provence | 220/697 |
| D345,833 | S | | 4/1994 | Teuran | D32/54 |
| D346,054 | S | | 4/1994 | Spangler | D32/54 |
| 5,322,183 | A | | 6/1994 | Strachan | 220/697 |
| D353,243 | S | | 12/1994 | Millard | D32/54 |
| D358,914 | S | | 5/1995 | Masse | D32/54 |
| 5,568,879 | A | * | 10/1996 | Kovathana | 220/700 |
| 5,687,873 | A | | 11/1997 | Jones | 220/736 |
| D405,574 | S | | 2/1999 | Riky | D32/54 |
| D431,363 | S | | 10/2000 | Boyette | D3/315 |

* cited by examiner

*Primary Examiner*—Joseph M. Moy
(74) *Attorney, Agent, or Firm*—Arthur J. Hansmann

(57) ABSTRACT

A unit comprised two sections of a paint brush holder and a paint brush wiper. Those two sections are together in one integral unit and are releasably attachable to a conventional paint container. The unit can be made of plastic which is sufficiently sturdy for the purpose and which is sufficiently flexible for snapping onto the upper ledge of the paint container. The entire assembly with the paint container is such that there is no obstruction in the repeated action of dipping the brush into the paint in the container, and the wiper accommodates brushes up to the largest size of four inch width, and the wiped paint is directed to flow back into the container.

14 Claims, 3 Drawing Sheets

Fig. 2
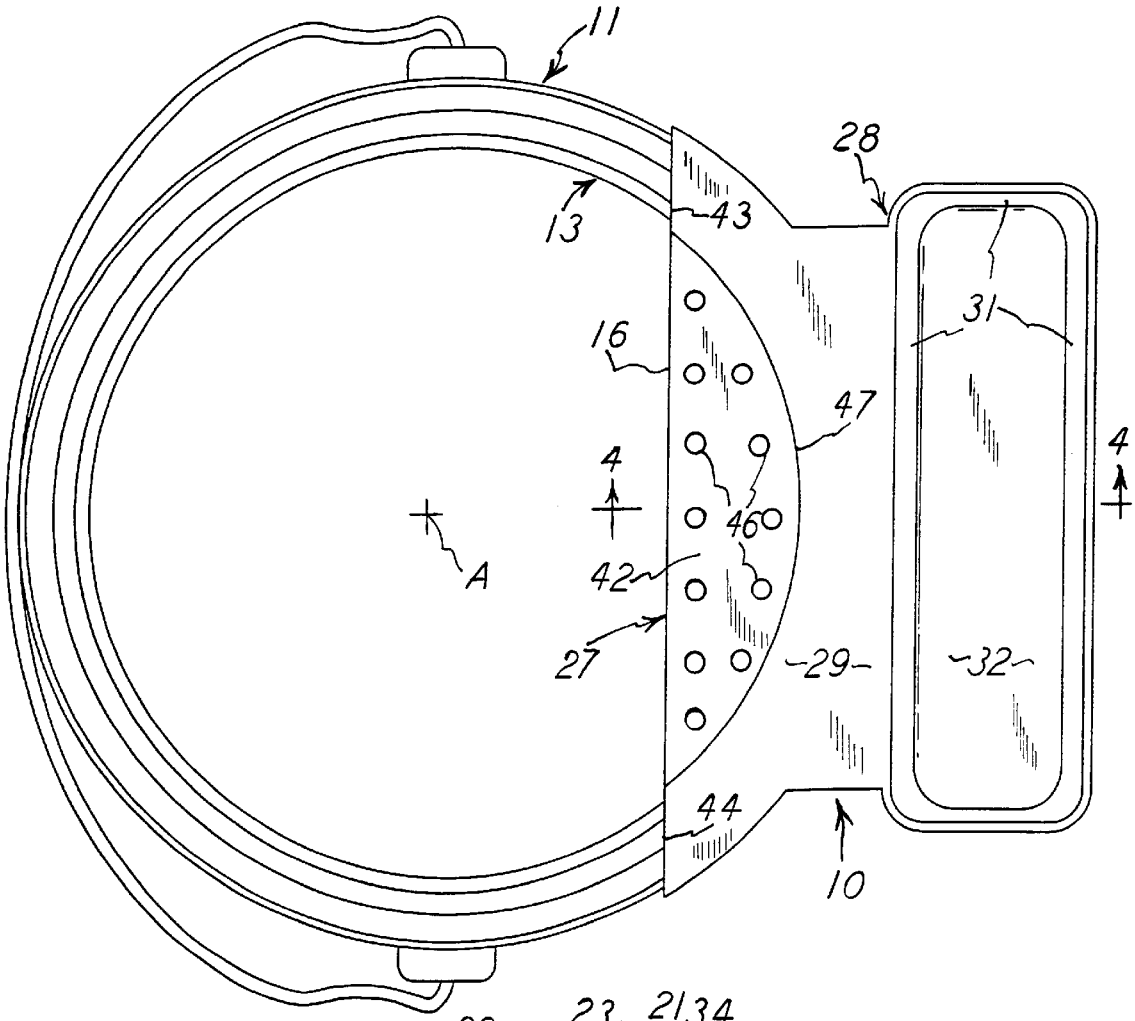
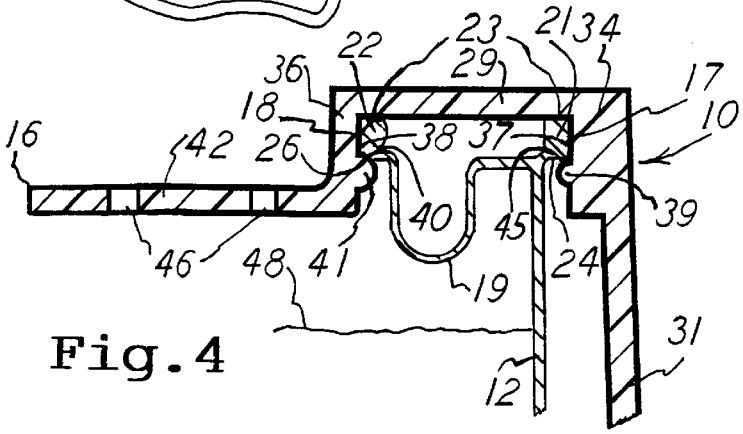
Fig. 4

PAINT BRUSH HOLDER AND WIPER UNIT

This invention pertains to a paint brush holder and wiper unit, and, more particularly, it pertains to a brush holder and wiper unit which is readily, easily, and securely mounted onto a paint container, such as the standard gallon paint can.

BACKGROUND OF THE INVENTION

The prior art is already aware of various attachments to paint containers for holding and wiping a paint brush. Those attachments are shown in both U.S. design and utility patents.

The present invention improves upon the prior attachments in significant ways. Included in the improvements is the fact that this invention is of a paint container attachment which serves the two functions of containing the paint brush in a compartment suspended on the container and of providing a brush wiper disposed directly over the open container and not extending down into the paint which is in the container.

In achieving the foregoing, the attachment is readily, easily, and securely connected onto the paint containers It does not extend into the paint to become covered with paint, and it does not obstruct movement of the brush into and out of the container in the process of painting.

Additionally, the invention precludes having paint run into the can ledge groove, and the wiper directs paint run-off from the brush and back into the container. The wiper is a straight edge and it can have holes to allow the wiped paint to flow back into the container.

For easy and secure mounting of the unit onto the container, the unit is flexible, and it can be made of plastic. The overall shape is tapered so that a plurality of the units can be nested to conserve storage space.

The unit of this invention is arranged to accommodate paint brushes of sizes up to the large four inch width. This is accomplished without having the unit block movement of the brush into and out of the paint container, so the dipping action employed during the loading of the brush with paint can be conveniently performed. Also, where the container has a carrying handle, the unit does not interfere with holding the container by the handle when the unit is in use during painting.

The foregoing, and other objects and advantages, will become more apparent upon reading the following description in conjunction with the accompanying drawings.

BRIEF DESCRIPTION OF THE DRAWINGS

FIG. 2 is a top plan view of FIG. 1.

FIG. 4 is a sectional view taken along the plane designated by the line 4—4 on FIG. 2, and having enlarged lines and being on an enlarged scale.

DETAILED DESCRIPTION OF A PREFERRED EMBODIMENT

The drawings and this description disclose a unit comprised of a paint brush holder and a paint brush wiper. Those two sections are together in one integral unit and are releasably attachable to a conventional paint container. The unit can be made of plastic which is sufficiently sturdy for the purpose and which is sufficiently flexible for snapping onto the upper ledge of the paint container. The entire assembly with the paint container is such that there is no obstruction in the repeated action of dipping the brush into the paint in the container, and the wiper accommodates brushes up to the largest size of four inch width.

Figure 1:
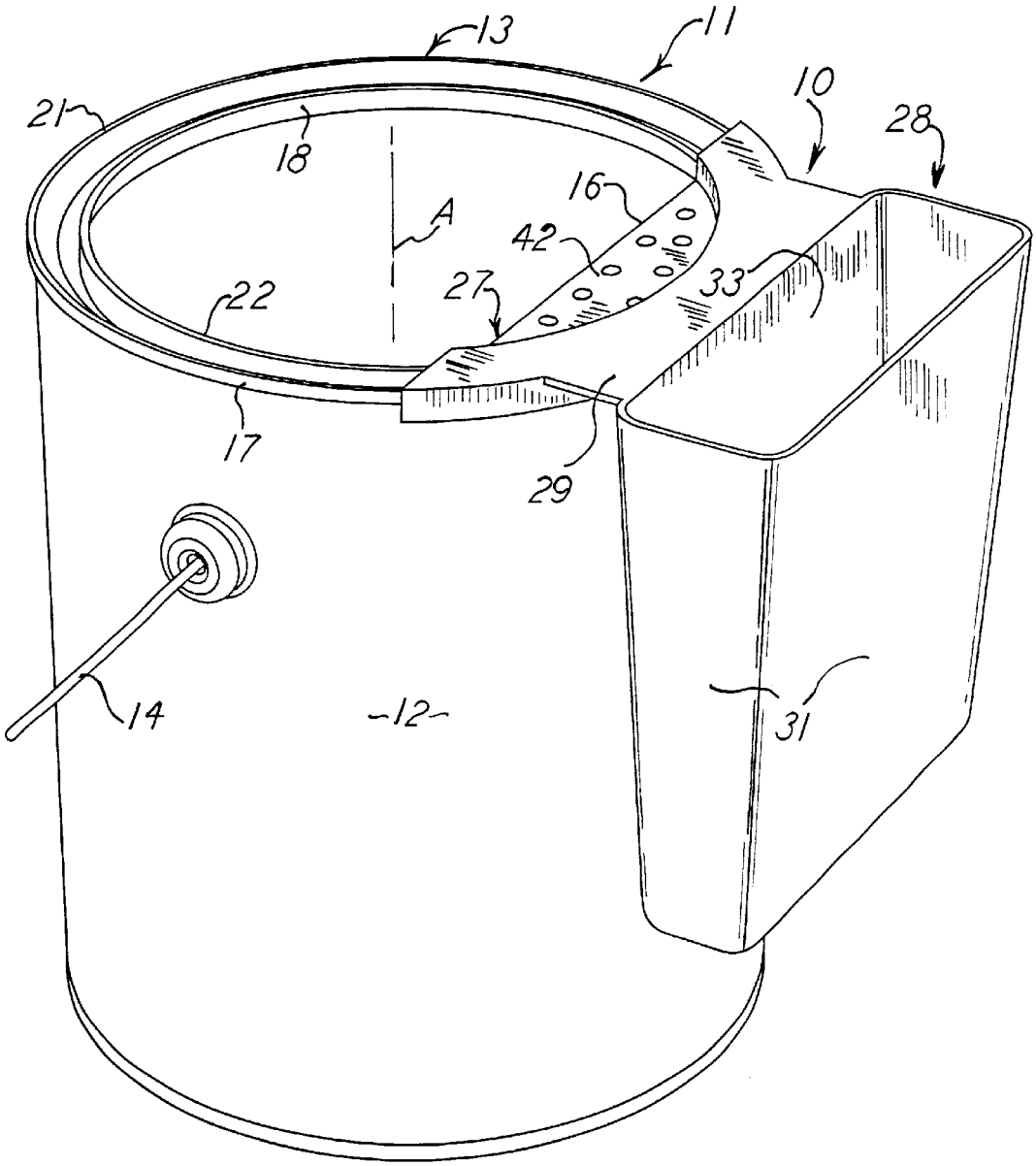
FIG. 1 is a top perspective view of the unit of this invention mounted onto a paint container.
Figure 3:
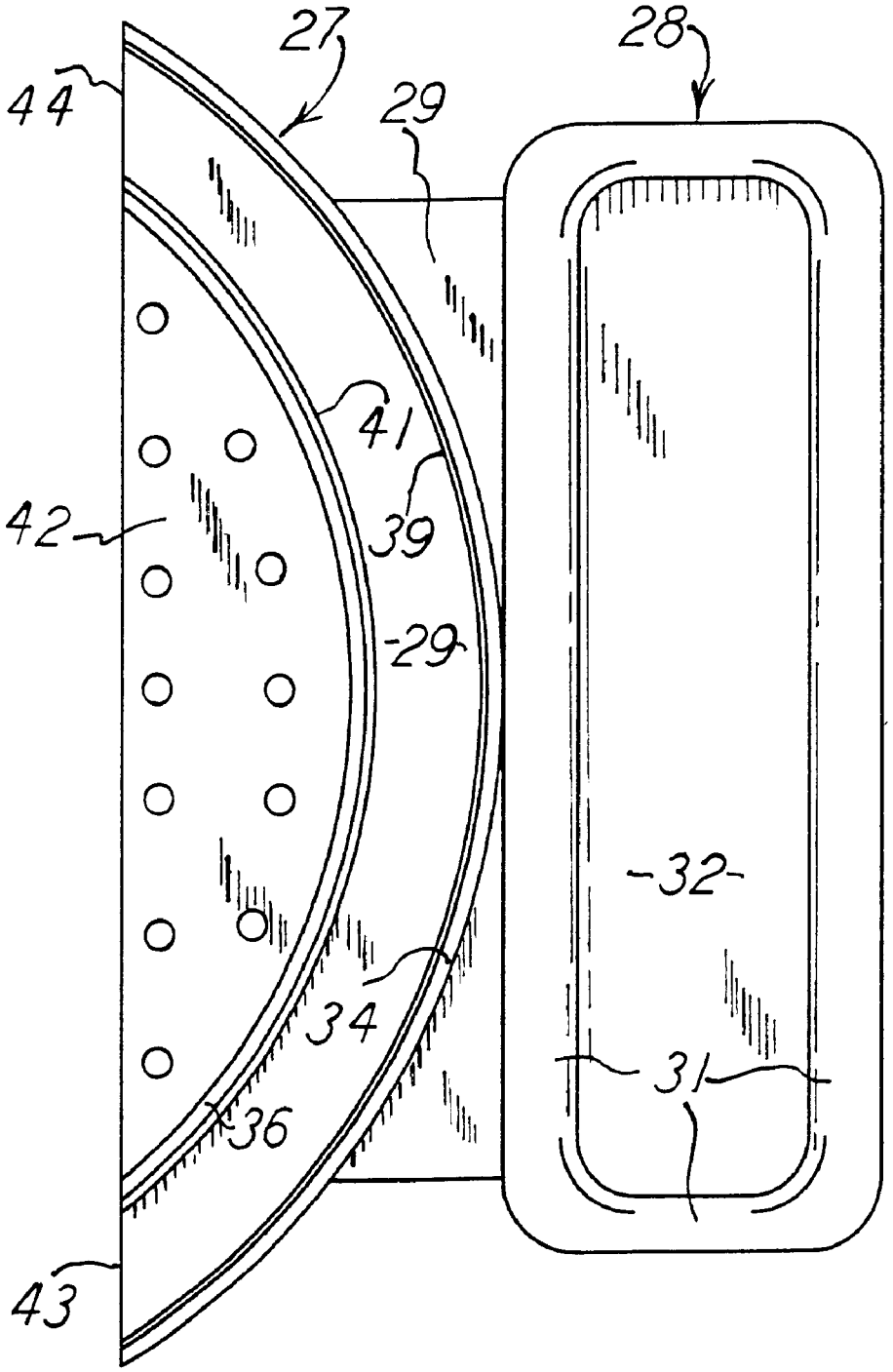
FIG. 3 is a bottom plan view of the unit of FIG. 1 shown by itself.

FIGS. 1 and 2 show a unit 10 mounted onto a conventional gallon paint container or can 11. The container 11 is cylindrical about an upright axis A, and it has the usual upright cylindrical wall 12 and an upper ledge 13. Also, there is the usual bale-type handle 14 pivoted on the wall 12 for lifting and holding the container when the handle is pivoted to its usual extended position above the wall and onto the axis A. In that position, the painter can dip the unshown brush into the paint in the container and move the brush past the handle 14 and onto the unit 10, all without any obstruction.

That is, FIGS. 1 and 2 both show ample clearance between the axis A, where the raised handle would be positioned, and the near edge 16 of the unit 10. The edge 16 is the wiper edge or doctor for the brush, and the brush can be of the maximum brush width of four inches and be fully extended and single-stroke wiped against the edge 16 for full and complete wiping action in the usual removal of excess paint from the brush in preparation of applying the paint-loaded brush to the surface to be painted.

The container ledge 13 is circular in top view and centered about the central axis A. The ledge 13 exists in its usual configuration, and, as shown in FIG. 4, it has the radially outwardly facing surface 17, the radially inwardly facing surface 18, and the offset intermediate extent 19, with all being integral and connected onto the upper edge of the wall 12.

It will be noticed that the surfaces 17 and 18 exist on respective circular and parallel beads 21 and 22 on the ledge 13, and the surfaces 17 and 18 are spaced apart a distance in their upright and continuous circular extents. The extent 19 is downwardly disposed at a distance from the upper level 23 of the ledge 13. Of course the described shape of the ledge 13 is for the conventional purpose of air-tightly holding an unshown container top onto the container 11. The beads 21 and 22 each have a downwardly facing circular surface, surfaces 24 and 26, respectively.

The unit 10 includes an attachment and wiping portion 27 and a paint brush compartment portion 28, with the two portions 27 and 28 being integral relative to each other and being preferably made in a single plastic molding process. Thus there is an intervening horizontally extending shelf 29 between and interconnecting the portions 27 and 28. The portion 28 has four upright walls, each designated 31, and a bottom 32 liquid tight with the walls. Thereby the compartment presents an upwardly open brush compartment with its upper open entry 33 of a size to receive a four inch brush. With both the wiper and holder being of a respective length and width to accommodate a brush four inches wide, those two dimensions are related and substantially the same, also as seen in FIG. 2. The walls 31 are tapered relative to each other so a plurality of the units 10 can be nested and stacked for space conservation.

The attachment and wiping portion 27 has two downwardly extending legs 34 and 36 and the intervening extent 29 with all integrally connected together through one molding process. The legs 34 and 36 are disposed on respective arcs which are parallel to each on radially outer and inner arcs relative to the axis A. The curvature of the arcs of the legs 34 and 36 are respectively the same as that of the beads 21 and 22. Accordingly, the legs 34 and 36 respectively present a radially inwardly facing surface 37 and a radially outwardly facing surface 38. The distance between the surfaces 37 and 38 is the same as that between the can surfaces 17 and 18, so the unit 10 is secure on the can 11.

The unit 10 is made of a flexible material so the legs 34 and 36 can flex relative to each other to thereby move onto and off from the ledge 13. The action is a snap action, and the overhanging position of the compartment 28 tends to assure the securement of the attachment onto the can 11.

In addition, the legs 34 and 36 are shown to have respective projections 39 and 41 which respectively engage the can downwardly facing surfaces 24 and 26. With the projections 39 and 41 the unit can be removed from the can 11 only upon flexing the legs 34 and 36 to release them from the can ledge 13. Projections 39 and 41 have upwardly facing engagable surfaces 40 and 45. Projection 39 could be omitted because of the cantilever overhang of brush compartment 28 tending to hold the unit downwardly. Where the projections 39 and 41, or only the projection 41, are used, they can extend as beads throughout the arcs of the respective legs 34 and 36, and, to the extent of their respective overlie with the legs 34 and 36, they conform to the configuration of the can surfaces 17 and 18.

The unit 10 also includes the wiping edge 16 which is the terminal edge of a plate 42 integral in the unit 10 and extending as a fragment of a solid circle in top view, as seen in FIG. 2. Thus, the edge 16 extends fully and straight between terminal ends 43 and 44 of the arcuate shape of the legs 34 and 36, and, as shown, it presents a sharply angulated wiping corner. Also as shown in FIG. 2, the arcuate spacing between the ends 43 and 44 is less than one-quarter of the circumference of the can ledge 13, and the edge 16 extends straight, continuously, and directly between those two ends 43 and 44.

Thus the edge 16 is the paint brush wiping edge and extends as a chord across the arc formed by the legs 34 and 36. The chord 16 is of a length to flatly and fully receive a four inch brush for wiping. The plate 42 is disposed at an elevation lower than that of the unit portion 29, and thus wiping the brush will cause the wiped paint to flow back into the container, rather than onto the ledge 13. Further, if desired, there can be holes 46 extending through the plate 42 to further direct the wiped paint to flow back into the can 11. Also, with the plate 42 integral with the leg 36 along the interconnected arc 47, the plate 42 gives strength to the legs 34 and 36 which can be subjected repeated mounting and removal relative to the can 11.

The leg projections 39 and 41 actually form grooves for capturing the beads 21 and 22 on the can, so it can be stated that the legs 34 and 36 do have grooves for effecting the snap fit disclosed herein.

FIG. 4 shows a normally full can with the paint up to the elevation 46. However, this invention has the unit leg 36 and plate 42 disposed above the level of the full paint can, and above the elevation of the lowest position of the ledge at 19, so the unit 10 is not contaminated with paint.

It should be understood that the unit 10 can be scaled to fit onto paint containers of sizes other than the gallon size, and it can also be used on containers having liquids other than paint and for applying those other coatings with the use of a brush. In all instances, the unit 10 serves to avoid the run-off of the coating onto the ledge of the container being used, and the wiping edge is a sharp edge and of a length to accommodate the width of the brush being used.

What is claimed is:

1. A paint brush holder and wiper unit for releasable attachment onto a paint container having an upright wall defining an open paint-containing interior and said wall having an upper end and a circular ledge extending circumferentially and for a first distance from said upper end and toward said interior and extending uprightly for a second distance, comprising:

said unit having a first portion engagable with said ledge along the second distance for restricting movement of said unit in a direction away from the container interior, said unit having a second portion spaced the first distance from said first portion and being engagable with the container wall for restricting movement of said unit in a direction toward the container interior and thereby releasably secure said unit on the container, said first and said second portions coextensively extending continuously throughout respective arcs parallel to each other and arcuately extending to two respective terminal ends and for an arcuate distance less than one-quarter of the circumference of the container ledge and said first and second portions are flexible and free of any openings therein along their arcs, said unit having a third portion including an upwardly open compartment formed by an upright wall enclosure and a bottom for receiving a paint brush in said compartment in an upright disposition, a brush wiper on said first portion and having a straight edge thereon at an elevation lower than that of said first portion for accommodating wiping a paint brush on said edge and directing paint run-off from the brush directly into the open interior and with said straight edge integral with and extending continuously and straight between said terminal ends, and a horizontally extending plate of the shape of a fragment of a solid circle in top plan view and extending integral with and as a chord across said first portion and presenting said wiper edge.

2. The paint brush holder and wiper unit an claimed in claim 1, wherein:

said first and said second portions are parallel to each other and are solids extents free of any holes therein and are resiliently movable relative to each other for snapping onto the ledge, and said first portion extends relative to said second distance for a distance less than said second distance.

3. The paint brush holder and wiper unit as claimed in claim 1, including:

a bead extending on each of said first and said second portions for contacting the container and thereby hold said unit onto said container.

4. The paint brush holder and wiper unit as claimed in claim 1, including:

an upwardly facing surface on said first portion engagable with said ledge for releasably upwardly restricting movement of said first portion.

5. A paint brush holder and wiper unit for releasable attachment onto a cylindrical paint container having an upright central axis and an opening therearound and an upright wall centered about the axis and defining an open paint-containing interior and the wall having an upper end and an endlessly circularly ledge having a circumference and upwardly extending inner and outer portions relative to the axis and being radially spaced apart for a first distance and with the ledge extending parallel to the axis for a second distance comprising:

said unit having a first portion of an inverted U-shape with two upright and spaced apart legs and an integral horizontally extending upper extent between said legs and with said first portion extending along an arc conforming to the cylindrical shape of the container and having two spaced-apart terminal ends on said arc and extending for a total extent of less than one-quarter of the circumference of the ledge, said legs being parallel to each other and spaced apart the amount of said first distance and being resilient for releasably snapping downwardly snugly onto the ledge and thereby releasably mount said first portion onto the ledge, a paint brush wiper on said first portion and extending in a straight and complete line between and integral with said terminal ends as a chord on said first arcuate portion and being disposed radially inwardly on said at a distance no greater than one-quarter radially inwardly across the container opening for wiping a paint brush on said wiper and have the wiped paint fall into the container, and said unit having a second portion integral with said first portion and including an upwardly open compartment formed by an upright wall enclosure and a bottom for receiving a paint brush in said compartment in an upright disposition.

6. The paint brush holder and wiper unit as claimed in claim 5, including:

said U-shape of said first portion extending continuously throughout said arc between said two terminal ends, and a horizontally extending plate integral with said first portion and being of a shape of a fragment of a solid circle in a top view which is along the axis and with said plate incorporating said wiper.

7. The paint brush holder and wiper unit as claimed in claim 6, wherein:

said plate has holes spaced throughout said plate for paint to pass through and Into the container.

8. The paint brush holder and wiper unit as claimed in claim 6, wherein:

said plate is disposed at an elevation lower than the elevation of said horizontal extent of said first portion.

9. The paint brush holder and wiper unit as claimed in claim 5, wherein:

said first portion extends parallel to the axis only for the amount no greater than said second distance.

10. The paint brush holder and wiper unit as claimed in claim 5, wherein:

said walls of said second portion extend only in flat planes and said second portion is of a tapered shape for nesting a plurality of said units into each other for space conservation.

11. The paint brush holder and wiper unit as claimed in claim 5, including:

each of said legs having a projection thereon respectively disposed to face each other and thereby engage the container when snapped into position on said container.

12. A paint brush holder and wiper unit for releasable attachment onto a cylindrical paint container having an upright central axis and an upright wall centered about the axis and defining an open paint-containing interior with an upper circular opening and the wall has an upper end and a ledge with a complete circumference and upwardly extending inner and outer portions relative to the axis and being radially spaced apart for a first distance and with the ledge extending parallel to the axis for a second distance and with said ledge inner portion having a downwardly facing surface, comprising:

said unit having a first portion extending along an arc conforming to the cylindrical shape of the container and extending for approximately only one-quarter of the ledge circumference and being positionable adjacent the container ledge inner portion and having two spaced-apart terminal ends on said arc, said unit first portion having an upwardly facing surface on the arcuately outer curvature thereof and being contactable by said downwardly facing surface of said ledge inner portion for releasably restraining said unit against upward movement relative to said container, a straight paint brush wiper on said first portion and having a four-inch length and extending as a chord straight and continuously between said terminal ends for wiping a paint brush on said wiper and have the wiped paint fall into the container, and said unit having a second portion integral with said first portion and including an upwardly open compartment formed by four planar walls presenting an upright wall enclosure and having a bottom, all for receiving a four-inch wide paint brush in said compartment in an upright disposition and being positionable at the container wall adjacent the exterior of said paint container and having a four-inch width extending tangentially to the container wall.

13. The paint brush holder and wiper unit as claimed in claim 12, wherein:

said wiper is a plate extending within said arc and is at an elevation lower than the highest elevation of said first portion of said unit and has a plurality of holes spaced therein for paint to pass through and into the container.

14. The paint brush holder and wiper unit as claimed in claim 13, wherein:

said first portion extends parallel to the axis only for the amount no greater than said second distance.

* * * * *